United States Patent [19]

Hara et al.

[11] Patent Number: 4,750,732

[45] Date of Patent: Jun. 14, 1988

[54] APPARATUS FOR CONVEYING AND GROUPING PRINTED MATTER OR LIKE OBJECTS

[75] Inventors: Kiyotaka Hara, Ohmiya; Takeshi Nakamura, Kawasaki, both of Japan

[73] Assignees: Tokyo Kikai Seisakusho; Kyodo Insatsu, both of Tokyo, Japan

[21] Appl. No.: 903,025

[22] Filed: Sep. 2, 1986

[51] Int. Cl.[4] ..... B65H 7/02

[52] U.S. Cl. ..... 271/258; 271/151; 271/182; 271/202; 271/270

[58] Field of Search ..... 271/270, 275, 150, 151, 271/234, 245, 237, 182, 183, 189, 202, 203, 235

[56] References Cited

U.S. PATENT DOCUMENTS

| | | | |
|---|---|---|---|
| 3,724,840 | 4/1973 | Kuckermann | 271/182 X |
| 3,948,153 | 4/1976 | Dutro | 271/189 X |
| 4,133,523 | 1/1979 | Berthelot | 271/202 X |
| 4,183,518 | 1/1980 | Bruckmuller | 271/202 X |
| 4,265,443 | 5/1981 | Berthelot | 271/182 |

FOREIGN PATENT DOCUMENTS

| | | |
|---|---|---|
| 52-13443 | 4/1977 | Japan . |
| 58-13459 | 3/1983 | Japan . |

*Primary Examiner*—Richard A. Schacher

*Attorney, Agent, or Firm*—Trexler, Bushnell, Giangiorgi & Blackstone, Ltd.

[57] ABSTRACT

An apparatus for grouping a plurality of printed or like objects into a plurality of equal sets, while they are conveyed in a row in which they overlap one another in a mutually equally spaced apart relation, includes an upstream conveyor supported on a plurality of rollers and a downstream conveyor disposed downstream of the upstream conveyor at a level of height which is lower than that of the upstream conveyor. At least one of the rollers is disposed above the downstream conveyor so that the upstream conveyor vertically overlaps the downstream conveyor to transfer each of the objects to the downstream conveyor along a downward path. An object holding device is provided above that portion of the upstream conveyor which is supported on the at least one roller. The holding device is downwardly movable for holding one of the objects against the upstream conveyor in response to a signal indicating that another object immediately preceding the one object has passed over the at least one roller, while a predetermined number of objects forming one group of objects ending with the immediately preceding object is counted by a counter.

26 Claims, 2 Drawing Sheets

APPARATUS FOR CONVEYING AND GROUPING PRINTED MATTER OR LIKE OBJECTS

BACKGROUND OF THE INVENTION

1. Field of the Invention:

This invention relates to an apparatus for grouping flexible, identically shaped sheetlike objects, such as copies of newspaper or other printed matter, into sets or lots which are composed of an equal number of objects, while they are being conveyed in a row in which they overlap one another in a mutually equally spaced apart relation.

2. Description of the Prior Art:

When a multiplicity of printed and folded objects which are identical in shape are conveyed in a long and orderly row in which they overlap one another in a mutually equally spaced apart relation, they must be divided into a plurality of groups prior to their delivery to the next step of the production process. They must be grouped accurately into a plurality of sets consisting of an equal number of objects without causing any disorder in their row between one set and another, even if they may be conveyed at a high speed.

There are known a variety of apparatus for dividing such a row of mutually overlapping objects positioned in close proximity to one another. They usually include a pawl which is lowered toward a conveyor belt to hold the printed objects upstream of the pawl against movement temporarily. They are further classified into two main types by the pawl which they have, i.e., an apparatus having a pawl of the simply descending type as disclosed, for example, in Japanese Patent Publication No. 13459/1983 and an apparatus having a pawl of the type which can both descend and move along the conveyor belt as disclosed, for example, in Japanese Patent Publication No. 13443/1977.

In either event, however, it is not easy to lower the pawl to a level of height which best suits the thickness of each of various kinds of printed objects. The failure to lower the pawl to an appropriate level of height ca result in a variety of problems. If the pawl is lowered too much, it holds the rear edge portion of the last object in the row downstream of the pawl and prevents it from being conveyed. There is every likelihood that the last object may be spaced apart from the other objects of the same group by so large a distance that it cannot be clearly identified as one of the objects belonging to that group. If the pawl is, on the other hand, lowered insufficiently, it may fail to hold the first object in the row upstream thereof and be, therefore, unable to group the objects properly.

When the pawl of the simply descending type is lowered, the objects upstream of the pawl can no longer move forward, but gather behind the pawl, while losing their appropriately spaced apart overlapping relationship. This problem remains present even after the pawl has been raised. The objects which have gathered displace themselves transversely of the conveyor belt. This disorder in the row of objects has an adverse effect on any subsequent step of the production process.

These drawbacks have been overcome by the pawl of the descending and moving type. However, it is very difficult, even if not impossible, to rely upon only a single pawl for grouping a long row of closely contiguous objects conveyed in a mutually spaced apart overlapping relation. Therefore, even the latter type of pawl is not free from the problems which can arise if it is lowered too much or insufficiently.

SUMMARY OF THE INVENTION

It is a first object of this invention to provide an apparatus which can overcome the drawbacks of the prior art as hereinabove pointed out and can quickly and accurately group a multiplicity of objects into a plurality of sets composed of an equal number of objects as instructed, without causing any disorder in a row in which they are con- veyed.

This object is attained by an apparatus including an upstream conveyor supported on a plurality of rollers, a downstream conveyor onto which a plurality of objects are transferred one by one while they are conveyed in a row, at least one of the rollers being located above the downstream conveyor, a first holding device which can be lowered to that portion of the upstream conveyor which is supported on the at least one roller, and a second holding device which can be lowered to that portion of the downstream conveyor which is spaced apart from the first holding device by a distance substantially equal to the unit length of the objects.

It is a second object of this invention to provide an apparatus which can maintain an orderly row of appropriately spaced apart overlapping objects both upstream and downstream of any division thereof into two different groups, while separating any such groups from each other by a sufficiently large distance.

This object is attained by an apparatus further including a tension roll mechanism which is provided between rolls guiding the returning portion of the upstream conveyor for storing any excess of the upstream conveyor over its length which is required for the normal transportation of the objects, the tension roll mechanism being movable along the row of the objects to permit the downstream displacement of the first holding device in its lowered position and the at least one roller, while the second holding device is also displaceable downstream, the downstream conveyor having a conveying speed which is somewhat higher than the speed at which the first holding device and the at least one roller are displaceable.

The printed or like objects are conveyed in a closely contiguous row having an appropriately spaced apart overlapping relationship. This relationship is briefly broken each time one of the objects is transferred down from the upstream conveyor to the downstream conveyor. During such transfer, each object is spaced apart from each of the adjoining two objects by a greater distance. Therefore, if the first holding device is lowered to hold one of the objects against the upstream conveyor, it can be separated instantaneously from the immediately preceding object which is transferred onto the downstream conveyor.

If at the same time the first holding device and the at least one roller are displaced downstream, the excess of the upstream conveyor is fed downstream from the tension roll mechanism to maintain the appropriately spaced apart overlapping relationship of the objects on the upstream conveyor. The downstream conveyor has a conveying speed which is somewhat higher than the speed at which the excess of the upstream conveyor is fed downstream. This difference in speed enables a greater spacing between the two holding devices and thereby a clearer division between two groups of objects.

Other objects, features and advantages of the invention will be apparent from the following description and the accompanying drawings.

DETAILED DESCRIPTION OF THE INVENTION

Figure 1:
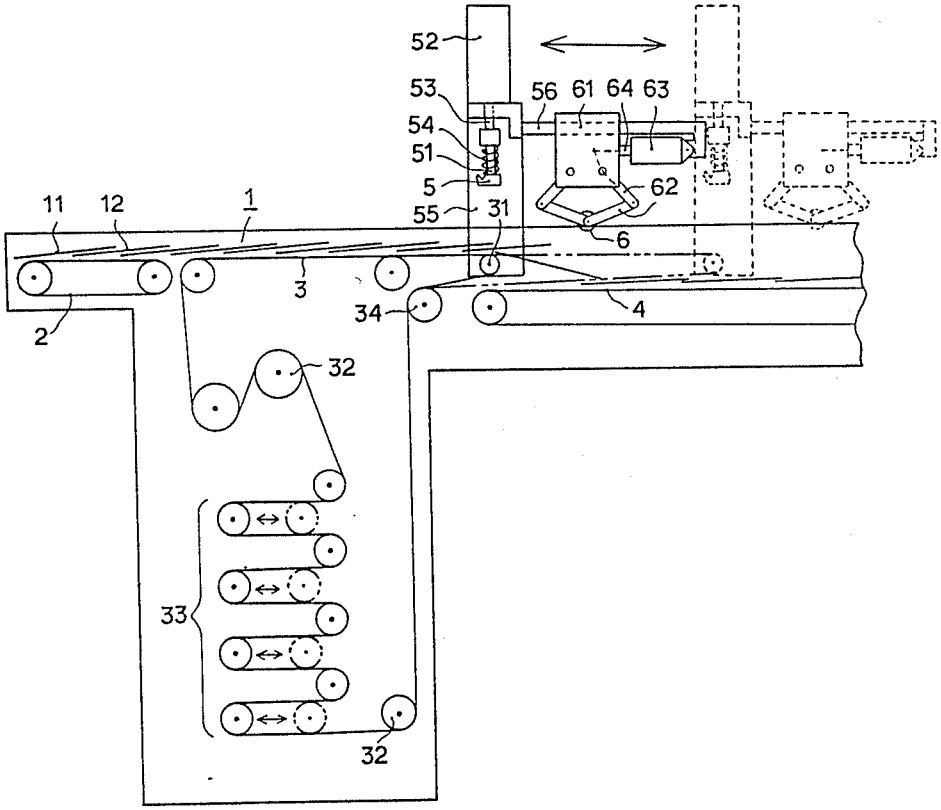
FIG. 1 is a schematic side elevational view of an apparatus embodying this invention showing it in its normal conveying position and a grouping device in its inoperative position.

An apparatus embodying this invention is schematically shown in FIG. 1. A multiplicity of identically shaped printed objects 11, 12, . . . which have been printed and folded one after another are delivered on a supply conveyor 2 and progressively form a row 1 in which they overlap one another in a mutually closely spaced apart relation.

The apparatus of this invention comprises an upstream conveyor 3 positioned downstream of the supply conveyor 2 adjacent thereto and a downstream conveyor 4 located downstream of the upstream conveyor 3. The upstream conveyor 3 comprises a conveyor belt having a portion which is supported on a plurality of rollers, and on which the objects are conveyed. One of the rollers which is shown at 31 is remoter from the supply conveyor 2 than the other rollers are. The roller 31 is located above the downstream conveyor 4 so that each of the objects may be lowered onto the downstream conveyor 4 when it is transferred thereto from the upstream conveyor 3.

The downstream conveyor 4 is designed for conveying the objects at a somewhat higher speed than the upstream conveyor 3, so that the objects may be more greatly spaced apart from one another when they have been transferred from the upstream conveyor 3 to the downstream conveyor 4. Although the upstream and downstream conveyors 3 and 4 may be designed for conveying the objects at the same speed, it is preferable to move the downstream conveyor 4 at a higher speed in order to facilitate the grouping of the objects, as far as the row in which the objects overlap one another can be maintained.

A first holding device 5 is provided above the roller 31 on which the most downstream end of the upstream conveyor 3 is supported. The device 5 is connected to a piston rod 53 in an air cylinder 52 by a power transmitting rod 51. The air cylinder 52 is secured to a side plate 55 on which the roller 31 is supported at one end. If the air cylinder 52 is actuated, the first holding device 5 is lowered and cooperates with the roller 31 to hold one of the objects against the upstream conveyor 3. An elastic member, such as a compression spring 54, is preferably provided along the rod 51 for reducing any impact that may arise when the device 5 strikes against the roller 31.

A second holding device 6 is provided above the downstream conveyor 4. It is spaced apart from the first holding device 5 by a distance which is substantially equal to the unit length of the objects. As different kinds of objects have different unit lengths, the second holding device 6 has a base portion 61 supported slidably on an arm 56 extending downstream from the side plate 55 and is, therefore, movable to or away from the first holding device 5. The device 6 includes a link mechanism 62 joined to the base portion 61 and shaped like a pantograph. The link mechanism 62 has one end connected to a piston rod 64 extending from an air cylinder 63, so that the device 6 may be raised or lowered with the movement of the rod 64 and may hold one of the objects against the downstream conveyor 4 when it is lowered.

The objects are counted by a counter of the known type not shown, as they are conveyed on the upstream conveyor 3. As soon as the nth object $1_n$ has passed over the roller 31 at the end of the upstream conveyor 3, a pulse counter or like device responds to a signal indicating that a predetermined number of objects has been counted, and transmits a signal to the air cylinders 52 and 63. The air cylinders 52 and 63 are actuated simultaneously to move their piston rods 53 and 64, respectively, and thereby lower the first and second holding devices 5 and 6 simultaneously.

Figure 2:
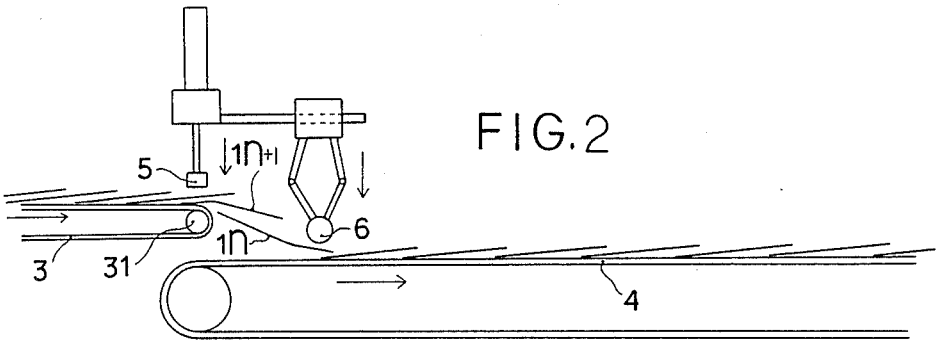
FIG. 2 is a fragmentary enlarged view of the apparatus showing the grouping device which is being moved to its operative position.

When the first and second holding devices 5 and 6 have been lowered, the second holding device 6 contacts the leading edge portion of the object $1_n$ being transferred from the upstream conveyor 3 to the downstream conveyor 4 and holds the object $1_n$ against the downstream conveyor 4, while the first holding device 5 simultaneously contacts the trailing edge portion of the immediately following object $1_{n+1}$ passing over the roller 31 and holds it against the upstream conveyor 3, as shown in FIG. 2. The objects forming the row 1 are, therefore, divided instantaneously into two groups between the objects $1_n$ and $1_{n+1}$. One of the groups which includes the object $1_n$ stays on the downstream conveyor 4, while the other group including the object $1_{n+1}$ is retained on the upstream conveyor 3.

Although two holding devices 5 and 6 have been shown, it is possible to omit the second holding device 6. The first holding device 5 holds the object $1_{n+1}$ against the upstream conveyor 3 on the roller 31 to thereby enable the division of the row 1 into two groups of objects, while the object $1_n$ is allowed to drop on the downstream conveyor 4.

The downstream conveyor 4 is preferably driven to convey the objects at a higher speed than the upstream conveyor 3 so that the two groups of objects may be separated from each other by a sufficiently large spacing, even if the holding devices 5 and 6 may work only briefly.

In order to ensure a clearer division between the two groups of objects on the downstream conveyor 4, it is necessary to enlarge the spacing between the objects $_1$n and $1_{n+1}$. However, it is important to ensure that the enlarged spacing should not cause any disorder in the arrangement of objects in either group.

In this connection, reference is made to FIG. 1 showing a tension roll mechanism 33 associated with the belt forming the upstream conveyor 3. The tension roll mechanism 33 is provided between two guide rollers 32 about which the rotating endless belt forming the upstream conveyor 3 is supported when it returns to its conveying position. The tension roll mechanism 33 comprises two parallel rows of rollers and is provided for storing any excess of the conveyor belt over its length which is required for the normal transportation of the objects. The rollers belonging to one of the rows are movable to and away from those of the other row in order to release the excess of the belt when moved toward the rollers of the other row.

The side plate 55 on which the roller 31 is supported is movable by a device connected thereto, but not shown, along the path along which the objects are conveyed on the downstream conveyor 4. Therefore, the roller 31 is also movable in the same direction.

A roller 34 is provided for driving the upstream conveyor 3. The roller 34 is driven to rotate the conveyor 3 when it conveys the objects. The operation of the roller 34 is, however, stopped and it is allowed to rotate freely when the roller 31 is moved in a downstream direction when two groups of objects are separated from each other.

If the roller 31 is moved in the downstream direction, the excess of the belt 3 is released from the tension roll mechanism 33 with the movement of a part of its rollers and extends along the downstream conveyor 4, as shown by a broken line in FIG. 1. If it is released at a speed which is substantially equal to the speed at which the upstream conveyor 3 conveys the objects, the row 1 of the objects on the conveyor 3 can maintain a constant overlapping relationship during the release of the belt from the tension roll mechanism 33. If the belt is released at a speed which is somewhat lower than the conveying speed of the upstream conveyor 3, the objects which are supplied from the conveyor 2 to the conveyor 3 form a row in which they overlap one another in closer proximity to one another, but as the downstream conveyor 4 has a higher relative speed, the spacing between every two adjoining objects is enlarged quickly. This adjustment can be further quickened if the downstream conveyor 4 is designed for increasing its conveying speed synchronously with the release of the upstream conveyor 3.

Figure 3:
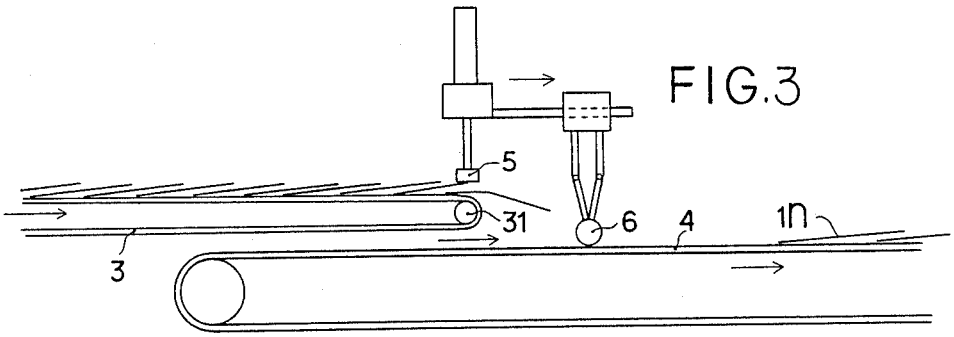
FIG. 3 is another fragmentary enlarged view showing how two groups of objects are separated from each other by a sufficiently large distance.

The downstream movement of the roller 31 and the resulting release of the upstream conveyor 3 are carried out when the first and second holding devices 5 and 6 are both in their lowered positions, as shown in FIGS. 2 and 3. As the roller 31 and the first and second holding devices 5 and 6 are all supported by the side plate 55, the movement of the roller 31 does not change the positional relationship of the holding devices 5 and 6 and the roller 31. However, as the downstream conveyor 4 has a higher relative speed than the speed at which the roller 31 and the holding devices 5 and 6 are moved, it is necessary to release the object $1_n$ from the holding force of the second holding device 6 in order to enable it to catch up with the other objects on the downstream conveyor 4 so that all of the objects belonging to one group may maintain an equally spaced apart overlapping relationship.

This requirement can be satisfied if the second holding device 6 is formed from a rotatable cylinder, ball or endless belt, though not specifically shown in the drawings. Alternatively, it is effective for the same purpose to form the surface of the downstream conveyor 4 from a material having a high coefficient of friction or shape it so that it may have a high coefficient of friction. It is also possible to raise the second holding device 6 away from the object $1_n$ on any such occasion.

Figure 4:
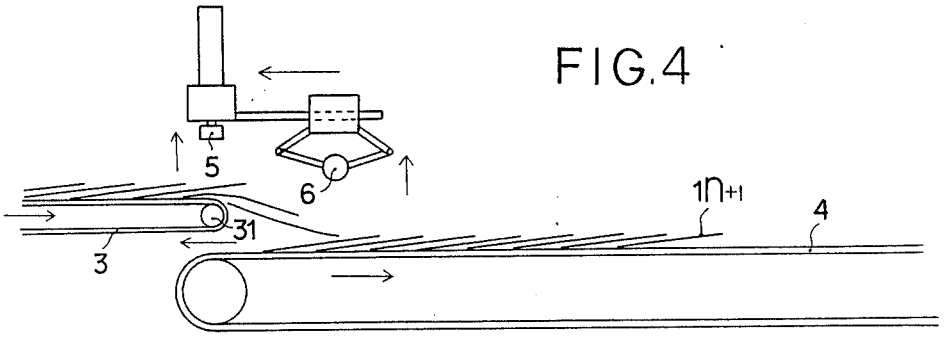
FIG. 4 is still another fragmentary enlarged view showing the grouping device which is moved back to its inoperative position.

As soon as the two separated groups of objects obtain a sufficiently large distance therebetween due to the different speeds of the upstream and downstream conveyors 3 and 4, the downstream movement of the roller 31, etc. is no longer necessary. Then, the air cylinders 52 and 63 are actuated in response to a signal from a limit switch not shown to return the first and second holding devices 5 and 6 to their respective raised positions. The upstream conveyor 3 is returned to its normal conveying position when the side plate 55 is moved back by the device not shown to return the roller 31 and the holding devices 5 and 6 to their respective original positions, as shown in FIG. 4. The objects are continuously transferred from the upstream conveyor 3 to the downstream conveyor 4 along a downward path therebetween during the return of the apparatus to its position shown in FIG. 4, too.

According to this invention, the conveying portion of the upstream conveyor 3 has an end positioned in overlapping relation above the downstream conveyor 4. This overlapping arrangement is based on the overlapping relation of the objects to be conveyed and grouped. While the object reaching the end of the upstream conveyor 3 is held by the first holding device 5, the difference in height between the conveyors 3 and 4 enables its instantaneous separation from the objects on the downstream conveyor 4. This grouping can be carried out accurately without causing any disorder in the row of objects on the upstream or downstream conveyor, as the first holding device is operationally associated with a counter which counts the predetermined number of objects forming each group.

The location of the upstream conveyor 3 above the downstream conveyor 4 has also the advantage that it is movable in a downstream direction to ensure a still clearer division between two separated groups of objects, while not causing any disorder in the row of objects on the upstream conveyor 3. The higher conveying speed of the downstream conveyor 4 relative to that of the upstream conveyor 3 and the speed at which the upstream conveyor 3 is extended in a downstream direction further facilitates the separation of one group of objects on the downstream conveyor 4 from another group on the upstream conveyor 3.

It has hitherto been often the case that the last object on the downstream conveyor fails to be properly conveyed. This invention ensures the freedom of any such problem and the maintenance of an orderly row of objects on the downstream conveyor 4, too, as the holding force of the second holding device 6 can be minimized, or as it is even possible to omit the second holding device 6.

Therefore, the apparatus of this invention enables the grouping of, for example, printed pages which ensures the freedom of any trouble in operation during all of the subsequent steps including collection, numbering and bookbinding.

What is claimed is:

1. In an apparatus for grouping a plurality of printed or like objects into a plurality of equal sets, while they are conveyed in a row in which they overlap one another in a mutually equally spaced apart relation, the improvement which comprises:

an upstream conveyor supported on a plurality of rollers;

a downstream conveyor disposed downstream of said upstream conveyor at a level of height which is lower than that of said upstream conveyor, at least one of said rollers being disposed above said downstream conveyor so that said upstream conveyor vertically overlaps said downstream conveyor to transfer each of said objects to said downstream conveyor along a downward path; and a first holding device provided above that portion of said upstream conveyor which is supported on said at least one roller, said holding device being downwardly movable for holding one of said objects against said upstream conveyor in response to a signal indicating that another object immediately preceding said one object has passed over said at least one roller, while a predetermined number of objects forming one group of objects ending with said immediately preceding object is counted by a counter.

2. In an apparatus for grouping a plurality of printed or like objects into a plurality of equal sets, while they are conveyed in a row in which they overlap one another in a mutually equally spaced apart relation, the improvement which comprises;

an upstream conveyor supported on a plurality of rollers;

a downstream conveyor disposed downstream of said upstream conveyor at a level of height which is lower than that of said upstream conveyor, at least one of said rollers being disposed above said downstream conveyor so that said upstream conveyor vertically overlaps said downstream conveyor to transfer each of said objects to said downstream conveyor along a downward path;

a roll mechanism provided between some of said over rollers for storing any excess of said upstream conveyor over its length which is required for conveying said objects, said at least one roller being movable in a downstream direction for allowing said roll mechanism to release said excess and thereby extend said upstream conveyor in said downstream direction over said downstream conveyor, said downstream conveyor having a conveying speed which is somewhat fast relative to the speed at which said at least one roller is movable in said downstream direction; and a first holding device provided above that portion of said upstream conveyor which is supported on said at least one roller, said holding device being lowerable for holding one of said objects against said upstream conveyor in response to a signal indicating that another object immediately preceding said one object has passed over said at least one roller, while a predetermined number of objects forming one group of objects ending with said immediately preceding object is counted by a counter, said holding device being movable in its lowered position in said downstream direction with said at least one roller for separating said one object from said immediately preceding object on said downstream conveyor by a sufficiently large distance, while maintaining the objects on said upstream conveyor in a properly overlapping relation.

3. In an apparatus for grouping a plurality of printed or like objects into a plurality of equal sets, while they are conveyed in a row in which they overlap one another in a mutually equally spaced apart relation, the improvement which comprises:

an upstream conveyor supported on a plurality of rollers;

a downstream conveyor disposed downstream of said upstream conveyor at a level of height which is lower than that of said upstream conveyor, at least one of said rollers being disposed above said downstream conveyor so that said upstream conveyor vertically overlaps said downstream conveyor to transfer each of said objects to said downstream conveyor along a downward path;

a roll mechanism provided between some of said other rollers for storing any excess of said upstream conveyor over its length which is required for conveying said objects, said at least one roller being movable in a downstream direction for allowing said roll mechanism to release said excess and thereby extend said upstream conveyor in said downstream direction over said downstream conveyor, said downstream conveyor having a conveying speed which is somewhat fast relative to the speed at which said at least one roller is movable in said downstream direction;

a first holding device provided above that portion of said upstream conveyor which is supported on said at least one roller; and a second holding device provided above said downstream conveyor and spaced apart from said first holding device in said downstream direction by a distance which is substantially equal to the unit length of said objects, said first and second holding devices being simultaneously lowerable for holding one of said objects and another object immediately preceding said one object against said upstream and downstream conveyors, respectively, in response to a signal indicating that said immediately preceding object has passed over said at least one roller, while a predetermined number of objects forming one group of objects ending with said immediately preceding object is counted by a counter, said first and second holding devices being movable in their lowered positions in said downstream direction with said at least one roller for separating said one object from said immediately preceding object on said downstream conveyor by a sufficiently large distance, while maintaining the objects on said upstream conveyor in a properly overlapping relation.

4. An apparatus as set forth in claim 3, wherein said second holding device has a lower surface which contacts said immediately preceding object, but permits it to be properly conveyed even if said second holding device is in its lowered position.

5. An apparatus as set forth in claim 1, 2, 3 or 4, further including an elastic material provided on means for transmitting a force for lowering said first holding device.

6. An apparatus as set forth in claim 1, 2, 3 or 4, wherein said downstream conveyor has a conveying speed which is somewhat higher than that of said upstream conveyor.

7. An apparatus as set forth in claim 2, 3 or 4, wherein said speed of movement of said at least one roller is substantially equal to the conveying speed of said upstream conveyor.

8. An apparatus as set forth in claim 6, wherein said speed of movement of said at least one roller is substantially equal to the conveying speed of said upstream conveyor.

9. An apparatus as set forth in claim 2, 3 or 4, wherein said speed of movement of said at least one roller is lower than the conveying speed of said upstream conveyor.

10. An apparatus as set forth in claim 6, wherein said speed of movement of said at least one roller is lower than the conveying speed of said upstream conveyor.

11. An apparatus as set forth in claim 7, wherein said downstream conveyor has an increased conveying speed when said at least one roller is moved in said downstream direction.

12. An apparatus as set forth in claim 8, wherein said downstream conveyor has an increased conveying speed when said at least one roller is moved in said downstream direction.

13. An apparatus as set forth in claim 9, wherein said downstream conveyor has an increased conveying speed when said at least one roller is moved in said downstream direction.

14. An apparatus as set forth in claim 10, wherein said downstream conveyor has an increased conveying speed when said at least one roller is moved in said downstream direction.

15. An apparatus as set forth in claim 1, 2, 3 or 4, wherein that surface of said downstream conveyor which contacts said objects has a high coefficient of friction.

16. An apparatus as set forth in claim 6, wherein that surface of said downstream conveyor which contacts said objects has a high coefficient of friction.

17. An apparatus as set forth in claim 11, wherein that surface of said downstream conveyor which contacts said objects has a high coefficient of friction.

18. An apparatus as set forth in claim 12, wherein that surface of said downstream conveyor which contacts said objects has a high coefficient of friction.

19. An apparatus as set forth in claim 13, wherein that surface of said downstream conveyor which contacts said objects has a high coefficient of friction.

20. An apparatus as set forth in claim 14, wherein that surface of said downstream conveyor which contacts said objects has a high coefficient of friction.

21. An apparatus as set forth in claim 3 or 4, wherein said second holding device is designed for holding said immediately preceding object in such a way that said immediately preceding object may be conveyed properly with the other objects on said downstream conveyor.

22. An apparatus as set forth in claim 21, wherein said second holding device comprises a cylinder which is rotatable about its own axis to allow the movement of said immediately preceding object with said downstream conveyor.

23. An apparatus as set forth in claim 21, wherein said second holding device comprises a ball which is rotatable about its own center to allow the movement of said immediately preceding object with said downstream conveyor.

24. An apparatus as set forth in claim 21, wherein said second holding device comprises an endless belt which is movable to allow the movement of said immediately preceding object with said downstream conveyor.

25. An apparatus as set forth in claim 4, wherein said first and second holding devices and said at least one roller are all supported on a single side plate which is movable for moving said first and second holding devices and said at least one roller together in said downstream direction.

26. An apparatus as set forth in claim 2, 3 or 4, wherein the operation of said upstream conveyor is discontinued when said excess thereof is released from said roll mechanism.

* * * * *